US007486901B2

(12) United States Patent
Hamada et al.

(10) Patent No.: US 7,486,901 B2
(45) Date of Patent: Feb. 3, 2009

(54) IMAGE FORMING APPARATUS AND IMAGE FORMING METHOD

(75) Inventors: Shuta Hamada, Hachioji (JP); Akira Hamada, legal representative, Hyogo (JP); Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 11/285,813

(22) Filed: Nov. 22, 2005

(65) Prior Publication Data

US 2006/0198647 A1 Sep. 7, 2006

(30) Foreign Application Priority Data

Mar. 3, 2005 (JP) ..... 2005-058630

(51) Int. Cl.
*G03G 15/00* (2006.01)
*G03G 15/16* (2006.01)

(52) U.S. Cl. ..... 399/49; 399/296

(58) Field of Classification Search ..... 399/49, 399/296, 302, 308

See application file for complete search history.

(56) References Cited

U.S. PATENT DOCUMENTS

| | | | | |
|---|---|---|---|---|
| 5,923,920 | A * | 7/1999 | Ishida et al. | 399/46 |
| 7,013,105 | B2 * | 3/2006 | Omata | 399/296 |
| 2003/0123910 | A1 * | 7/2003 | Kim et al. | 399/296 |

FOREIGN PATENT DOCUMENTS

| | | | |
|---|---|---|---|
| JP | 01191171 | A * | 8/1989 |
| JP | 08248829 | A * | 9/1996 |
| JP | 10-274892 | | 10/1998 |
| JP | 11-143255 | | 5/1999 |

* cited by examiner

*Primary Examiner*—David M Gray
*Assistant Examiner*—Erika J. Villaluna
(74) *Attorney, Agent, or Firm*—Cantor Colburn LLP

(57) ABSTRACT

The invention prevents the phenomenon of occurrence of toner scattering or density fluctuations by changing the appropriate transfer conditions according to the toner charge of the toner images formed on an intermediate image transfer member. The density of toner images formed under prescribed image forming conditions on an intermediate image transfer member is detected, the toner charge is obtained from the detected density, and the pre-transfer charging section is controlled according to the obtained toner charge.

9 Claims, 2 Drawing Sheets

IMAGE FORMING APPARATUS AND IMAGE FORMING METHOD

CROSS REFERENCE TO RELATED APPLICATION

This application is based on Japanese Patent Application No. 2005-058630 filed on Mar. 3, 2005, in Japanese Patent Office, the entire content of which is hereby incorporated by reference.

BACKGROUND

1. Field of the Invention

The present invention relates to image forming apparatuses of the electro-photographic type.

2. Description of the Related Art

For example, in the color image forming apparatus of the electro-photographic method used in copying machines, printers, etc., normally, primary toner images of different colors are formed on image retainers, the toner images so formed are transferred on to an intermediate image transfer member by primary image transfer thereby forming a color toner image, and subsequently a secondary image transfer is made of this color toner image on to a recording material. Image forming methods of this type are used very often in color image forming apparatuses that form color images.

The magnitude of the potential of the toner layer of a toner image on the intermediate image transfer member is determined by the amount of toner adhered. While the secondary transfer conditions are normally set matching with the magnitude of the potential of the toner image in a mostly dark image, if the amount of toner adhered is large, various transfer defects occur during the secondary image transfer process. As a result, image defects occur in the obtained image such as density fluctuations, toners splashing, etc. This is because the appropriate secondary transfer conditions differ depending on the magnitude of the toner layer potential. In particular, in color image forming, since the amount of toner adhered on the intermediate image transfer member becomes large, the problems of density fluctuations, toners splashing, etc., become pronounced.

As examples to solve the above problem, methods have been proposed in which a processing is done before secondary image transfer on the color toner image using a scorotron charger having a discharging electrode and a grid electrode by applying an electric charge with the same polarity as that of the toner potential to the color toner image process and thereby adjusting the toner layer potential of that color toner image to become uniformly high, and carrying out secondary image transfer in that condition.

In Japanese Patent Application Laid Open No. Hei 10-274892 and in Japanese Patent Application Laid Open No. Hei 11-143255, by making always constant the magnitude of the grid voltage applied to the grid electrode, the toner layer potential of the toner image to be subjected to secondary image transfer has been made uniformly high.

Further, in Japanese Patent Application Laid Open No. Hei 11-143255, it has been proposed to keep constant the difference between the potential of the toner image to be subjected to secondary image transfer and the potential of the secondary image transferring unit. In addition, in this disclosure, a measure has been taken to change the output of the pre-transfer charging unit according to the number of superimposed toner layers.

However, according to the experiments conducted on transfer conditions by the present inventors, the toner layer potential does not become constant when the charging is done with the constant grid voltage. Further, the toner layer potential varies not only with the quantity of toner forming the toner image on the intermediate image transfer member but also on the extent of toner charging, that is, the amount of electrical charge per unit mass of toner. Therefore, it became clear that it is difficult to prevent sufficiently the image defects occurring during secondary image transfer using the method of keeping constant the output of the pre-transfer charging unit or using the method of controlling the output of the pre-transfer charging unit according to the number of superimposed toner layers.

In particular, when carrying out pre-transfer discharging by lowering the magnitude of the toner layer potential during the processing before transfer, in the conventional control methods of keeping the grid voltage constant it became clear that it is difficult to prevent sufficiently the lowering of image quality caused by secondary image transfer.

In view of this, technology is being desired that solves the above problems in conventional technology and prevents the lowering of image quality caused by secondary image transfer.

SUMMARY

The present invention may comprise an image forming apparatus that has an image retainer; an electrostatic latent image forming unit that forms an electrostatic latent image on the image retainer; a developing unit that forms a toner image by developing the electrostatic image; an intermediate image transfer member; a primary image transfer unit that transfers the toner image on the image retainer to the intermediate image transfer member; a secondary image transfer unit that transfers the toner image on the intermediate image transfer member to the recording material; a toner density sensor that detects the density of the toner image on the intermediate image transfer member; a pre-transfer discharging unit having a scorotron charger including a discharging electrode and a grid electrode that discharges the intermediate image transfer member before the image transfer by the secondary image transfer unit; and a control unit that controls the voltage applied to the discharging electrode; wherein a toner image is formed on the image retainer by operating the developing unit under prescribed conditions, the toner image is transferred to the intermediate image transfer member by the primary image transfer unit, the density of the toner image on the intermediate image transfer member is detected, and the control unit controls the voltage applied to the discharging electrode according to the toner density detected by the toner density sensor.

In addition, an image forming method comprising: (a) forming an electrostatic latent image on an image retainer; (b) forming a toner image by developing the electrostatic latent image on said image retainer; (c) forming a toner image on said intermediate image transfer member by carrying out primary image transfer of the toner image on the said image retainer on to said intermediate image transfer member; (d) carrying out pre-transfer discharging of the toner image on said intermediate image transfer member; (e) carrying out secondary image transfer of the toner image on said intermediate image transfer member on to a recording material after said pre-transfer discharging; wherein a toner image with a prescribed density is formed on the image retainer in said step (e), the density of the toner image on the intermediate image transfer member formed in said step (c) is detected, and said pre-transfer discharging is carried out based on the prescribed toner density on said image retainer and the detected toner density on said intermediate transfer member.

The invention itself, together with further features and attendant advantages, will best be understood by reference to the following detailed description taken in conjunction with the accompanying drawings.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

In the following description, like parts are designated by like reference numbers throughout the several drawings.

DESCRIPTION OF THE PREFERRED EMBODIMENT

In the following, although the present invention is described using a preferred embodiment, the scope and intent of the present invention shall not be construed to be limited to or by this preferred embodiment.

<Color Image Forming Apparatus>

Figure 1:
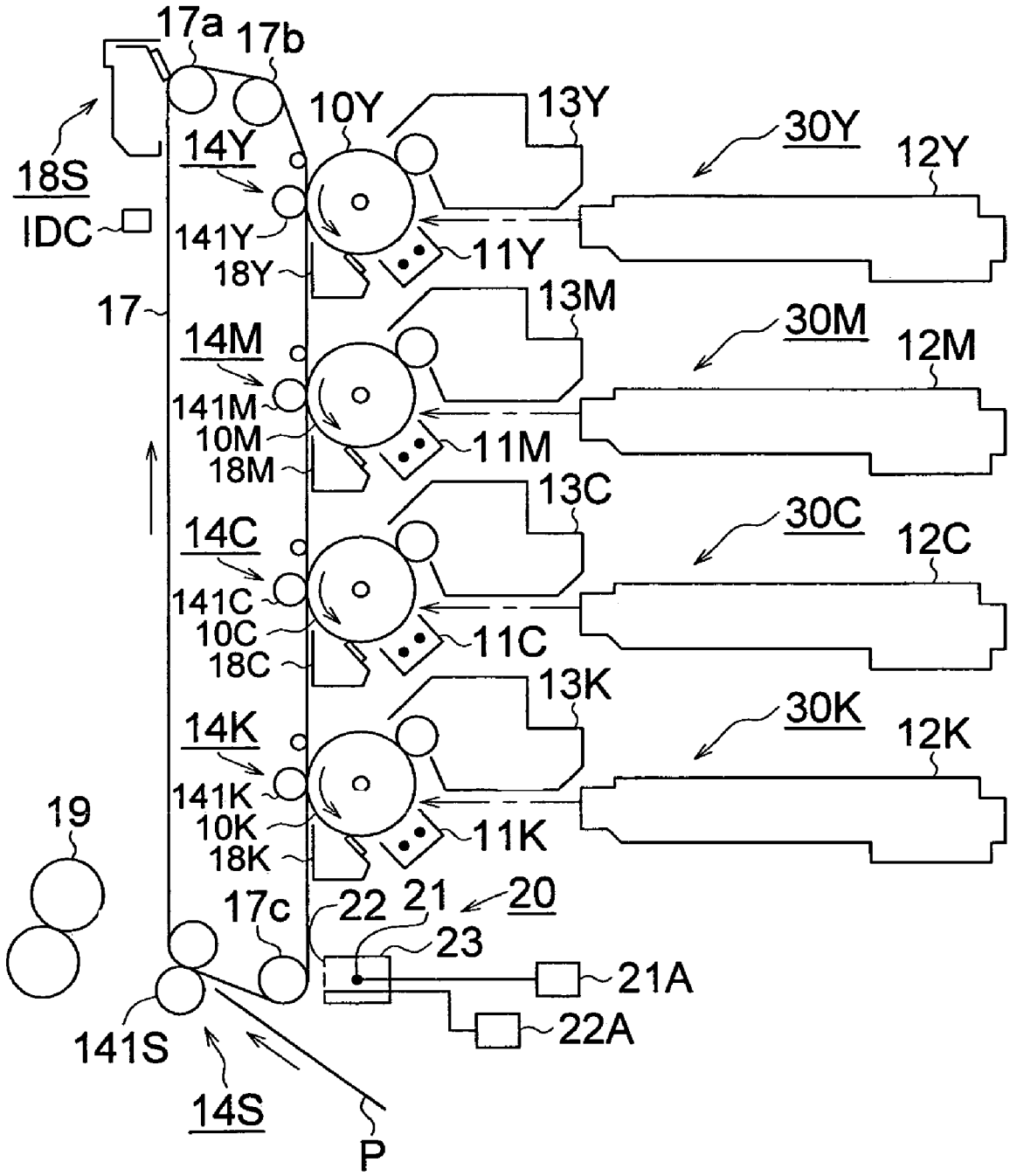
FIG. 1 is a diagram showing an example of the color image forming apparatus according to a preferred embodiment of the present invention.

FIG. 1 is a diagram showing an example of the color image forming apparatus according to a preferred embodiment of the present invention.

This image forming apparatus is a color image forming apparatus that forms color images, and is of the so-called intermediate image transfer type. In other words, the toner images of mutually different colors that are formed on a plurality of image retainers are successively transferred by primary image transfer on to a common intermediate image transfer member. Thereby superimposing the toner images of different colors one upon the other, and the color toner image is formed on the recording material by carrying out secondary image transfer in a single operation of transferring on to the transferring material the color toner image formed on this intermediate image transfer member.

This color image forming apparatus is provided with an intermediate image transfer member 17 that is made of an endless belt that carries out circulatory movement in the direction of the arrow shown in FIG. 1. On the outer peripheral surface area of this intermediate image transfer member 17, four toner image forming units 30Y, 30M, 30C, and 30K are provided in the direction of movement of the intermediate image transfer member 17, and provided in a mutually separated manner. The image forming units form respectively yellow toner image, magenta toner image, cyan toner image, and black toner image successively. The intermediate image transfer member 17 is entrained about a set of rollers having the intermediate rollers 17*a*, 17*b*, and 17*c* and the backup roller 17*d* to be described later. And the intermediate image transfer member 17 carries out circulatory movement while coming into contact with the image retainers 10Y, 10M, 10C, and 10K due to the primary image transfer unit 14Y, 14M, 14C, and 14K in the different toner image forming units 30Y, 30M, 30C, and 30K.

The intermediate image transfer member 17 is constituted by an endless belt having partial electrical conductivity such as, for example, having a surface resistivity of $17\ 1\times10^{4}\Omega$-$1\times10^{12}\Omega/cm^{2}$. The surface resistivity is a value measured using a resistance meter (HYRESTER-IP, manufactured by Yuka Electronics) in an environment of room temperature and room humidity (temperature of 20° C.±1° C. and relative humidity of 50±2%) by applying a voltage of 100 V for 10 seconds.

It is desirable that this intermediate image transfer member 17 is formed using polyimide type resins, for example, thermosetting polyimide, denatured polyimide, etc.

In the toner image forming unit 30Y of the yellow toner image is provided an image retainer which is a rotating drum-shaped image retainer 10Y. On the outer peripheral area of this image retainer 10Y, the charging unit 11Y, the exposure unit 12Y, and the developing unit 13Y that carries out development using a developing agent for the yellow toner image are provided all in that sequence, and in the direction of rotation of the image retainer 10Y. An image retainer cleaning unit 18Y having a cleaning blade that cleans the image retainer 10Y is provided at a downstream position of the primary image transfer unit 14Y provided at a position that is downstream compared to the developing unit 13Y in the direction of rotation of the image retainer 10Y.

The charging unit 11Y and the exposure unit 12Y constitute a latent image forming unit that forms the electrostatic latent image on the image retainer 10Y.

The image retainer 10Y has a photosensitive layer, for example, a resin made to include an organic photoelectric material on the outer periphery of a metallic drum-shaped base, and is placed so that it extends in a direction perpendicular to the paper surface in FIG. 1.

The charging unit 11Y has a scorotron charger having, for example, a control grid and a charging electrode, and the exposure unit 12Y can, for example, be a laser irradiation unit.

The developing unit 13Y, for example, is provided with a developing sleeve with built in magnet that rotates while carrying the developing agent and a bias voltage applying unit (not shown in the figure) that applies DC bias or DC bias superimposed with AC bias between the image retainer 10Y and the developing sleeve.

The primary image transfer unit 14Y has the primary transfer roller 141Y that is placed so as to form the primary image transfer area in the condition in which it is pressed against the surface of the image retainer 10Y via the intermediate image transfer member 17. And the primary image transfer unit 14Y has an image transfer current supply unit (not shown in the figure) having, for example, a constant current power supply that is connected to this primary transfer roller 141Y. The yellow toner image on the image retainer 10Y is transferred on to the intermediate image transfer member 17 by supplying current from the primary transfer current supply unit to the primary transfer roller 141Y, that is, the image transfer is of the so-called direct contact transfer method.

The cleaning blade of the image retainer cleaning unit 18Y is made, for example, of an elastic body such as urethane rubber, which is not only supported at its end part by a supporting member. In addition, the image retainer cleaning blade is also is provided so that its tip part presses against the surface of the image retainer 10Y, and the direction extending from the rear anchor side of the cleaning blade is the so-called counter-direction that is a direction opposite to the direction of movement due to rotation of the image retainer 10Y at the point of contact.

Even in each of the other toner image forming units 30M, 30C, and 30K, the configurations are similar to that of the toner image forming unit 30Y of the yellow toner image excepting that the developing agent used is, instead of the yellow toner, a magenta toner, a cyan toner, and a black toner, respectively.

Here, even in each of the primary image transfer unit 14M, 14C, and 14K of the toner image forming units 30M, 30C, and 30K, a primary transfer current is supplied with the same magnitude as the primary transfer current supplied to the primary image transfer unit 14Y of the toner image forming unit 30Y of the yellow toner image.

At a position further on the downstream side of the position of the toner image forming unit 30K for the black toner on the downstream side of the intermediate image transfer member 17, the secondary image transfer unit 14S is provided. The secondary image transfer unit 14S has the secondary transfer roller 141S that is placed so as to form the secondary image transfer area by pressing the backup roller 17*d* via the intermediate image transfer member 17, and the secondary image transfer voltage supply unit (not shown in the figure) that is connected to this secondary transfer roller 141S. The secondary image transfer unit 14S is of the so called direct contact transfer type in which the color toner image formed on the intermediate image transfer member 17 is transferred by secondary image transfer, by supplying current from the secondary transfer current supply unit to the secondary transfer roller 141S, on to the recording material P that has been fed by transporting up to it. Here, the color toner image forming unit is constituted from the toner developing units 30Y, 30M, 30C, and 30K, the intermediate image transfer member 17, and the secondary image transfer unit 14S.

Further, at a position on the downstream side of the secondary transfer unit 14S in the direction of movement of the intermediate image transfer member 17, the intermediate image transfer member cleaning unit 18S is provided. The intermediate image transfer member cleaning unit 18S is provided with a cleaning blade that removes the non-transferred toner remaining on the intermediate image transfer member 17.

The image retainers 10Y, 10M, 10C, and 10K, and the intermediate image transfer member 17 are made to operate as shown by the arrows, and toner images of the colors of yellow, magenta, cyan, and black are formed on the image retainers 10Y, 10M, 10C, and 10K. Subsequently, each toner image is transferred on to the intermediate image transfer member 17 by primary image transfer, thereby forming on the intermediate image transfer member 17 a multi-color toner image in which said single color toner images have been superimposed one over the other. This multi-color toner image on the intermediate image transfer member is then transferred on to the recording material P by secondary image transfer.

<Developing Agent>

It is desirable to use dual component developers as the developing agent having a toner and a carrier as the main constituents.

The toners used in the above color image forming apparatus should desirably be ones having a weight average particle diameter in the range of 4-7 μm. By using toners having a weight average particle diameter in the range of 4-7 μm, it is possible to reduce the presence of toners having excessive adhesion or toners having weak adhesion with the recording material P in the fixing process using the fixing unit, and hence not only it is possible to obtain stable development characteristics over long periods but also to obtain high transfer efficiency increasing the half-tone image quality, whereby visible images are formed having improved image quality of thin lines or dots, etc.

Here, the volume average particle diameter is the average particle diameter measured by a "Coulter Counter TA-II" instrument or by a "Coulter Multisizer" instrument (manufactured by Beckman-Coulter).

Such toners are obtained by polymerizing polymerizable monomers in a water-based medium, and the fine polymer particles are prepared, for example, by suspension polymerization or by emulsion polymerization of monomers in a liquid to which has been added an emulsifier liquid as a necessary additive, and thereafter, by the coagulating method of adding an organic solvent or a coagulant. At the time of coagulation, it is also possible to use the methods of carrying out coagulation after mixing dispersion liquids such as mold releasing agents or coloring agents necessary for the composition of the toner, or of carrying out emulsion polymerization after dispersing the toner constituent materials such as mold releasing agents or coloring agents. Here, the word coagulation implies the fusion of several particles of the resin and the coloring agent. In addition, the water-based medium in the present embodiment implies one that has at least 50% by mass of water.

Taking an example of the method of manufacturing such a toner, various constituent materials such as coloring agents and, if necessary, mold releasing agents, charge control agents, and also polymerization initiating agents, etc., are added to the polymerizing monomer. And the different constituent materials are dissolved or dispersed in the polymerizing monomer using a homogenizer, sand mill, sand grinder, or ultrasonic dispersing equipment, etc. This polymerizing monomer in which the different constituent materials are dissolved or dispersed is dispersed in a water based medium containing a dispersion stabilizing agent using a homo-mixer or a homogenizer so as to have oil droplets with the desired size as a toner. Thereafter, it is transferred to reaction equipment in which the stirring mechanism is stirring blades described later, and the polymerization process is made to proceed by heating. After the polymerization reaction is completed, the dispersion stabilizing agent is removed, and the toner is produced by filtering, cleaning, and further drying.

It is desirable that the degree of spherical nature of the toners such as the above is in the range of 0.94-0.98. The degree of spherical nature is obtained, for example, by sampling 500× enlarged toner particle images of 500 randomly chosen resin particles using a scanning electron microscope (SEM) and carrying out toner particle image analysis using an image analyzing equipment (the Scanning Image Analyzer manufactured by JEOL Ltd.) and calculating using Equation 2 below.

$$\text{Degree of spherical nature} = (\text{circumference of a circle with the same area as the particle projection}) / (\text{circumference of the particle projection}). \quad \text{Equation 2}$$

When the degree of spherical nature is less than 0.94, the unevenness of the particles becomes large, the particles are likely to be crushed due to being subjected to large stresses in the machine, and since the tone particles are not charged uniformly in the developing unit 13Y, 13M, 13C, and 13K, it is not possible to form satisfactory visible images. On the other hand, when the degree of spherical nature is higher than 0.98, since the toner particles are very close to being perfect spheres, the cleaning performance becomes degraded.

In the color image forming apparatus according to the embodiment, by using developing agents including toners that have been manufactured according to the method described above and that have shapes with spherical shapes and small diameters satisfying the specific conditions, it is possible to increase the half-tone image quality and to form visible images having improved image quality of thin lines or dots, etc.

The toners described above can be used as single component developing agents or as dual component developing agents.

When using the toners as single component developing agents, it is possible to consider the use of non-magnetic single component developing agents or magnetic developing agents in which the toner is made to include magnetic particles of sizes in the range of 0.1-0.5 μm, and either type of these can be used in the present embodiment.

Further, it is possible to use for the magnetic particles of the carrier, the materials considered conventionally as appropriately suitable such as metallic iron, ferrite, magnetite, etc., or alloys of such metals and other metals such as aluminum, lead, etc., and ferrite particles are particularly desirable. The volume average particle diameters of the above magnetic particles are desirably in the range of 15 μm-100 μm, and still more desirably in the range of 25 μm-80 μm.

The volume average particle diameters of the carrier can be measured typically using a laser diffraction type particle size distribution measuring apparatus "HELOS" (manufactured by Sympatec GmbH) provided with a wet type dispersion unit.

In this color image forming apparatus, the image forming operation is carried out in the following manner. That is, in each of the toner image forming units 30Y, 30M, 30C, and 30K, the image retainers 10Y, 10M, 10C, and 10K are rotated by driving, these image retainers 10Y, 10M, 10C, and 10K are charged to a specific polarity, for example, to negative polarity, by the charging units 11Y, 11M, 11C, and 11K. Next, in the image forming areas on the surfaces of the photosensitive members where the toner images are to be formed, the potentials are reduced at the illuminated locations (the exposed regions) due to the exposures by the exposing units 12Y, 12M, 12C, and 12K. So the electrostatic latent images are formed on the image retainers 10Y, 10M, 10C, and 10K corresponding to the image of the original document. The toners charged to the same polarity as the surface potentials of the image retainers 10Y, 10M, 10C, and 10K, for example, with a negative polarity, get adhered to electrostatic latent images of the photosensitive bodies 10Y, 10M, 10C, and 10K thereby carrying out reversing development and thus forming the toner images of the different colors.

Further, primary image transfer current is supplied from the respective primary image transfer unit 14Y, 14M, 14C, and 14K to the primary transfer areas of each of the toner image forming units 30Y, 30M, 30C, and 30K. Because of this, by carrying out primary transfer of the toner images of different colors successively and superimposing them one on the other, the color toner image is formed on the intermediate image transfer member 17.

The color toner image on the intermediate image transfer member 17 is transferred to the recording material P by the secondary image transfer unit 14S, and the color image so transferred is fixed by the fixing unit 19.

<Pre-Transfer Discharging Control>

A toner density sensor IDC that detects the density of the color toner image on the intermediate image transfer member 17 is provided at a position that is on the downstream side of the secondary image transfer unit 14S in the direction of movement of the intermediate image transfer member 17. And the position is also on the upstream side of the intermediate image transfer member cleaning unit 18S.

The toner density sensor IDC detects the density of the color toner image on the intermediate image transfer member 17. The toner sensor IDC has a reflection type density sensor that has a light emitting device that emits light on to the intermediate image transfer member 17 and a light receiving device that receives light reflected from the intermediate image transfer member 17.

Further, on the downstream side of the primary image transfer unit 14K at the most downstream position in the direction of movement of the intermediate image transfer member 17 and also on the upstream side of the secondary image transfer unit 14S, a pre-secondary transfer discharging unit 20 is provided. The pre-secondary transfer discharging unit 20 has, for example, a scorotron charger having a control grid, so as to be opposite the intermediate roller 17*c* via the intermediate image transfer member 17.

The pre-secondary transfer discharging unit 20 has the function of discharging the static electricity on the toner image on the intermediate image transfer member 17. And the pre-secondary transfer discharging unit 20 includes a discharging electrode 21 made of a discharging wire, a grid electrode 22, and a supporting member 23 that is made of a conducting material and that supports the discharging electrode 21 and the grid electrode 22.

The control grid 22 is provided opposite the surface of the intermediate image transfer member 17 so as to have a gap of, for example, 1 mm away from it.

This supporting member 23 is maintained in a state in which the potential on it is the same as that on the grid electrode 22, and the intermediate roller 17*c* is maintained in a grounded state.

Further, a voltage with a polarity opposite to that of the potential on the toner layer is applied to the discharging electrode 21 by the power supply 21A. And a voltage is applied to the grid electrode 22 from the grid power supply 22A with a polarity opposite to the polarity of the voltage applied to the discharging electrode 21, that is, a voltage is applied to the grid electrode that has the same polarity as the potential on the toner layer.

There is an appropriate value with a certain range for the toner layer potential of the toner image subjected to secondary image transfer, and when the potential deviates from this appropriate value, phenomena are more likely to occur such as character scattering if the potential is too low, or generation of transfer fluctuations if the potential is too high.

According to the experiments conducted by the present inventors, although it is possible to control the toner layer potential by the pre-transfer discharging operation, the toner image potential after the pre-transfer discharging operation is affected by the toner image potential before the pre-transfer discharging operation, and it became clear that it is necessary to carry out control according to the toner image potential before the transfer.

Figure 2:
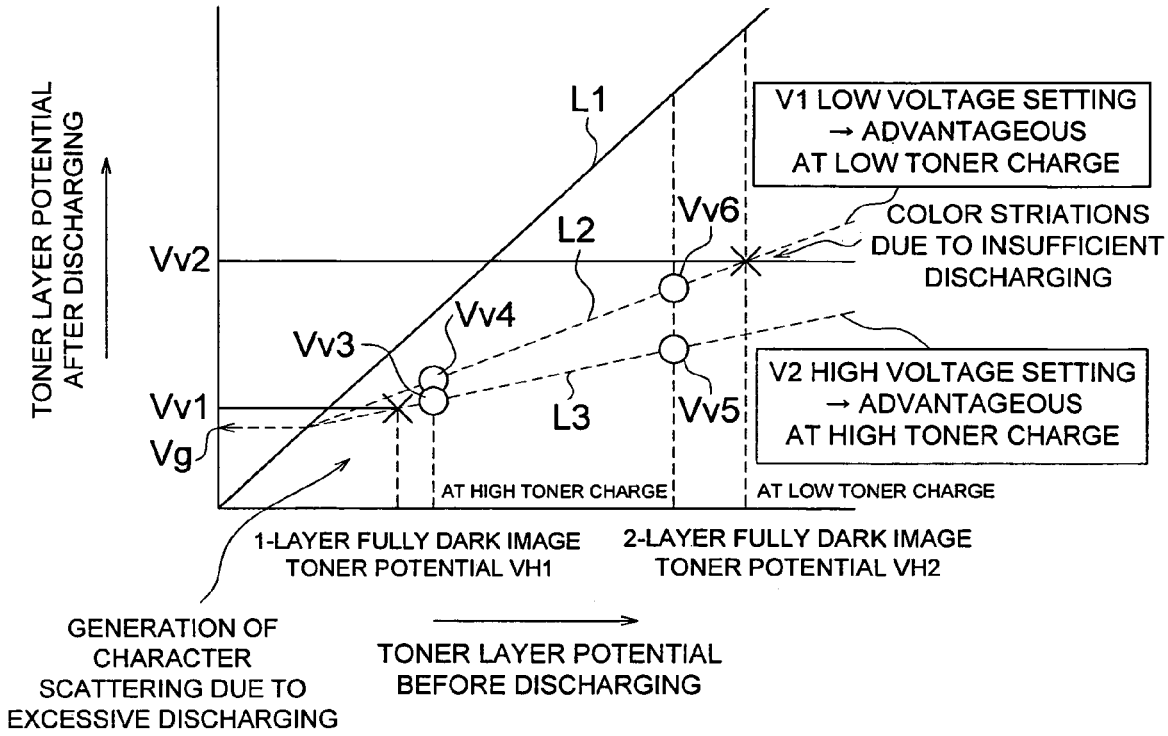
FIG. 2 is a graph showing the relationship between the toner layer potential before carrying out the pre-transfer discharging operation and the toner layer potential after carrying out the pre-transfer processing.

FIG. 2 shows the relationship between the toner layer potential before carrying out the pre-transfer discharging operation and the toner layer potential after carrying out the pre-transfer processing.

In FIG. 2, the horizontal axis represents the toner layer potential before the pre-transfer discharging operation, and the vertical axis represents the toner layer potential after the pre-transfer discharging operation. Further, since a negatively charged toner is used, the voltages in FIG. 2 are the magnitudes of negative voltages, that is, the absolute value of the voltage is indicated in this figure.

The straight line L1 indicates the case when there is no pre-transfer discharging operation, and of course, the straight line L1 is a straight line with an angle of inclination of 45°.

The case when the voltage of the grid electrode 22 is set to Vg (negative voltage) and a low (positive) voltage is applied to the discharging electrode 21 is shown by the straight line L2, and the case when a high (positive) voltage is applied is shown by the straight line L3 which indicates that the toner layer potential after the pre-transfer discharging operation is proportional to the toner layer potential before the pre-transfer discharging operation.

The toner layer potential after the pre-transfer discharging operation is affected not only by the toner layer potential before the pre-transfer discharging operation, but also varies with the voltage applied to the discharging electrode 21. In other words, since the discharging effect is large when the voltage applied to the discharging electrode is high, the relationship becomes a straight line with a low angle of inclination as indicated by the straight line L3, and since the discharging effect is small when the voltage applied to the discharging electrode is low, the relationship becomes a straight line L2 with a high angle of inclination.

Character scattering occurred when the toner layer potential after the pre-transfer discharging operation was less than Vv1, and transfer fluctuations occurred when toner layer potential after the pre-transfer discharging operation was more than Vv2.

Further, in the case of an almost dark image in which case the toner image consists of only one layer, since the quantity of toner constituting the toner image is small, the toner layer potential Vh1 before pre-transfer discharging operation is low, and since the quantity of toner is large in the case of almost dark image with two toner layers the potential of the toner layer Vh2 before discharging operation is high.

By making the potential corresponding to Vh1 after the pre-transfer discharging operation high such as Vv4 not Vv3, it is possible to prevent definitely character scattering. And further, by making the potential corresponding to Vh2 after the pre-transfer discharging operation high such as Vv5 not Vv6, it is possible to prevent definitely transfer fluctuations.

Table 1 shows the results of experiments related to the relationship between the toner charging level and the voltage applied to the discharging electrode 21. In the table 1, "B" shows good result and "D" shows bad result.

For the toners, we used toners whose toner charge values (the electrical charge per unit mass of the toner) were known beforehand by measurement, that is, we used three types of toners with toner charge values of −40 μC/g, −50 μC/g, and −60 μC/g.

As is shown by the # symbol in Table 1, when the applied voltage was 4 kV for the toner with a toner charge of −40 μC/g, 4 kV and 4.5 kV for the toner with a toner charge of −50 μC/g, and 4.5 kV and 5 kV for the toner with a toner charge of −60° C/g, the respective transfer rates were high, and also good images were formed with toner scattering during transfer being suppressed satisfactorily. Further, even single layer fully dark images and double layer fully dark images were formed satisfactorily, and it became clear that, in order to form good images, it is necessary to change the voltage applied to the discharging electrode in accordance with the toner charge. In Table 1, in the case of a single layer fully dark image, for example, when the voltage applied to the discharging electrode was 5 kV, although good transfer is made for a toner charge of −60 μC/g, in the case of toner charges of −40 μC/g and −50 μC/g, even during the transfer of toner images with the same quantity of adhesion the appropriate discharging condition differs depending on the toner charge in order to avoid the occurrence of transfer defects.

Therefore, it is necessary to change the voltage applied to the discharging electrode 21 in accordance with toner charge, and as is shown in Table 1, by applying a voltage to the discharging electrode 21 in accordance with the toner charge, it is possible to form images while sufficiently suppressing toner scattering and color fluctuations.

The toner charge is detected by the method described below.

The transfer rate changes depending on the toner charge. As a consequence, by forming the toner image while setting the conditions so that the density becomes constant, transferring the formed toner image, and by detecting the density of the transferred toner image, the density of the toner image

TABLE 1

Relationship among toner charge, toner layer potential, voltage applied to the discharging electrode, and image defects

| | Toner layer potential before discharging | | | Toner layer potential after discharging | | | | |
|---|---|---|---|---|---|---|---|---|
| Toner charge | 1-Layer fully dark image (V) | 2-Layer fully dark image (V) | Voltage applied to the discharging electrode (kV) | 1-Layer fully dark image (V) | 2-Layer fully dark image (V) | Toner splashing | Color striations | Decision |
| −40 μC/g | −90 | −170 | 5.5 | −30 | −70 | D | B | D |
| | | | 5 | −45 | −80 | D | B | D |
| | | | 4.5 | −55 | −100 | D | B | D |
| | | | #4 | −95 | −120 | B | B | B |
| | | | 3.5 | −90 | −145 | B | D | D |
| −50 μC/g | −100 | −190 | 5.5 | −35 | −80 | D | B | D |
| | | | 5 | −55 | −95 | D | B | D |
| | | | #4.5 | −70 | −115 | B | B | B |
| | | | #4 | −100 | −120 | B | B | B |
| | | | 3.5 | −100 | −145 | B | D | D |
| −60 μC/g | −110 | −210 | 5.5 | −45 | −90 | D | B | D |
| | | | #5 | −65 | −110 | B | B | B |
| | | | #4.5 | −75 | −125 | B | B | B |
| | | | 4 | −110 | −150 | B | D | D |
| | | | 3.5 | −110 | −155 | B | D | D |

before transfer and the density of the toner image after transfer can be known, and it is possible to detect the toner charge from the transfer rate calculated based on these two densities.

Figure 3:
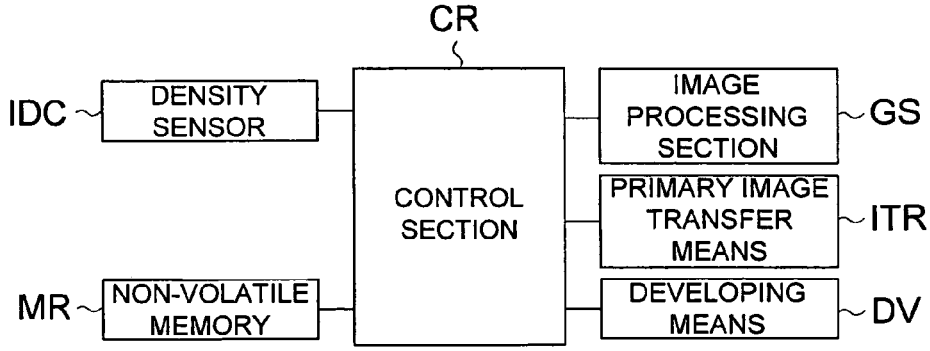
FIG. 3 is a block diagram of the control system executing the pre-transfer discharging control in a preferred embodiment of the present invention.

FIG. 3 is a block diagram of the control system executing the pre-transfer discharging control in a preferred embodiment of the present embodiment.

The control unit CR not only controls the image processing section GS that drives the exposure unit and generates the image data, but also carries out developing by setting the developing unit DV to the prescribed conditions. In this manner, because of setting the conditions of forming electrostatic latent images and the development conditions, toner images of prescribed density are formed on the image retainer. These conditions are selected, for example, as the conditions of forming halftone images in which case it is possible to detect changes in the density with the sensitivity. The toner image density when the image forming conditions having conditions of forming electrostatic latent images and development conditions are made equal to the prescribed conditions have been measured beforehand by experiments.

Next, the transfer conditions of the primary transfer unit TR1 are set to the prescribed conditions, the toner image is transferred from the image retainer to the intermediate image transfer member 17, and the density of the toner image on the intermediate image transfer member 17 is detected by the density sensor IDC.

Since the density of the toner image on the intermediate image transfer member 17 under prescribed image forming conditions, that is, the density of the toner image before transfer is known, the transfer rate is obtained from the density of the toner image after transfer detected by the density sensor IDC.

Further, since the toner charge corresponding to the transfer rate has already been obtained beforehand by experiment, it is possible to calculate the toner charge from the detection result of the density sensor IDC.

Table 2 shows the toner charge corresponding to the output of the density sensor IDC when a toner image for toner charge detection is formed under the following image forming conditions.

Development Conditions:

Toner: Cyan toner

Image retainer charging potential (potential of unexposed section): −700 V

Maximum exposure potential: −100 V

Development bias (DC voltage component): −600 V

Development bias (AC component): Voltage 1.5 kV (peak-to-peak), frequency 4 kHz

Primary transfer current: +90 μA

TABLE 2

| Toner charge | IDC Sensor output |
|---|---|
| −40 μC/g | 4.2 V |
| −50 μC/g | 4.0 V |
| −60 μC/g | 3.8 V |

In this manner, based on the obtained toner charge, the control unit CR controls the power supply 21A of the pre-transfer charging unit 20, and sets the voltage applied to the discharging electrode 21. For example, because of setting the voltage indicated by the # symbol in Table 1, images are formed with high image quality and sufficiently suppressed toner scattering and color fluctuations.

An example of control is as shown in Table 1, by setting respectively the applied voltage as 4 kV for the toner with a toner charge of −40 μC/g, 4 kV and 4.5 kV for the toner with a toner charge of −50 μC/g, and 4.5 kV and 5 kV for the toner with a toner charge of −60 μC/g, images were formed with high image quality and without fogging, scattering, and color fluctuations.

The value of the appropriate applied voltage corresponding to the toner charge is measured beforehand as is shown by the # symbol in Table 1 and is stored in a non-volatile memory MR, and the control unit CR sets the voltage applied to the discharging electrode 21 by referring to the table in the non-volatile memory MR.

The toner charge varies depending on the environmental conditions such as temperature and humidity, the history of usage of the developing agent and the toner, and the image forming conditions, etc. However, by controlling the pre-transfer charging unit 20 in accordance with the toner charge as has been explained above, a stable and high transfer rate is maintained at all times without being affected by the toner charge or by the quantity of toner adhesion and images of high image quality are formed.

In particular, in color image forming apparatuses images are formed without color fluctuations.

Since the design has been made so that the toner charges of the toners in the developing units 13Y, 13M, 13C, and 13K are almost equivalent, while it is possible to carry out sufficient control of pre-transfer discharging by detecting said toner charge in the case of single color or dual color toner images among the colors of yellow, magenta, cyan, and black. And it is also possible to operate all the four developing units 13Y, 13M, 13C, and 13K thereby forming said patch image, to detect the toner charges, and to carry out control of the power supply 21A of the pre-transfer discharging unit 20 based on the average value of the toner charges.

According to an embodiment of the present invention, it is possible to realize an image forming apparatus that can form stable and high quality images at all times without the generation of transfer defects even when the toner charges vary due to changes in the environmental conditions, history of usage of the developer, etc.

In addition, it is possible to detect the toner charge and to carry out control of pre-transfer discharging without making the apparatus complex for detecting the toner charge, and without having to stop the operation of the apparatus for long periods for detecting the toner charge.

Although in a color image forming apparatus severe image quality maintenance is demanded such as suppressing to a low level the density fluctuations that become the cause of color fluctuations, according to an embodiment of the invention, an image forming apparatus is realized that forms high quality images while sufficiently suppressing image defects such as color fluctuations, etc.

It is to be noted that various changes and modifications will be apparent to those skilled in the art. Therefore, unless such changes and modifications depart from the scope of the present invention, they should be construed as being included therein.

While the preferred embodiments of the present invention have been described using specific terms, such description is for illustrative purposes only, and it is to be understood that changes and variations may be made without departing from the spirit or scope of the appended claims.

What is claimed is:

1. An image forming apparatus comprising:

an image retainer;

an electrostatic latent image forming unit that forms an electrostatic latent image on the image retainer;

a developing unit that forms a toner image by developing the electrostatic image;

an intermediate image transfer member;

a primary image transfer unit that transfers the toner image on the image retainer to the intermediate image transfer member;

a secondary image transfer unit that transfers the toner image on the intermediate image transfer member to a recording material;

a toner density sensor that detects the density of the toner image on the intermediate image transfer member;

a pre-transfer discharging unit having a scorotron charger including a discharging electrode and a grid electrode that discharges the intermediate image transfer member before the image transfer by the secondary image transfer unit, the grid electrode being provided opposite to the surface of the intermediate image transfer member with a gap and between the discharging electrode and the intermediate image transfer member, wherein a voltage with a polarity opposite to the potential on the toner image is applied to the discharging electrode, and a voltage with the same polarity as the potential on the toner image is applied to the grid electrode; and a control unit that controls a voltage applied to the discharging electrode;

wherein a toner image is formed on the image retainer by the electrostatic latent image forming unit and the developing unit under prescribed conditions, the toner image is transferred to the intermediate image transfer member by the primary image transfer unit, the density of the toner image on the intermediate image transfer member is detected, and the control unit controls the voltage applied to the discharging electrode corresponding to toner charge obtained from a toner density of the toner image on the intermediate image transfer member after transferring by the secondary image transfer unit so that an electric potential of the toner image is set to a predetermined level.

2. An image forming apparatus of claim 1, wherein a color toner image comprising a plurality of single color toner images superimposed on one another is formed on said intermediate image transfer member, and the color toner image is transferred to the recording material by said secondary image transfer unit.

3. An image forming apparatus of claim 1, wherein said prescribed condition is the condition of forming the toner image with a prescribed density on said image retainer.

4. An image forming apparatus of claim 1, wherein the toner density sensor comprises a light emitting device that emits light onto the intermediate image transfer member and a light receiving device that receives light reflected from the intermediate image transfer member.

5. An image forming apparatus of claim 1, comprising an intermediate image transfer member cleaning unit on the downstream side of the toner density sensor.

6. An image forming apparatus of claim 1, comprising intermediate rollers at positions opposing the pre-transfer discharging unit prior to secondary transfer via the intermediate image transfer member.

7. An image forming apparatus of claim 6, wherein said intermediate rollers are maintained at ground potential.

8. An image forming apparatus of claim 1, wherein the toner image formed on said image retainer by operating said developing section under prescribed conditions is a halftone image.

9. An image forming apparatus of claim 1, wherein the control unit obtains the toner charge based on the toner density after transferring and a toner density before transferring.

* * * * *